US006093235A

United States Patent [19]

Reichel

[11] Patent Number: 6,093,235

[45] Date of Patent: Jul. 25, 2000

[54] PROCESS FOR DECARBONISING A HIGH-CHROMIUM STEEL MELT

[75] Inventor: Johann Reichel, Erkrath, Germany

[73] Assignee: Mannesmann AG, Düsseldorf, Germany

[21] Appl. No.: 09/066,483

[22] PCT Filed: Oct. 14, 1996

[86] PCT No.: PCT/DE96/01970

§ 371 Date: Apr. 23, 1998

§ 102(e) Date: Apr. 23, 1998

[87] PCT Pub. No.: WO97/15692

PCT Pub. Date: May 1, 1997

[30] Foreign Application Priority Data

Oct. 23, 1995 [DE] Germany ..... 195 40 490

[51] Int. Cl.[7] ..... C21C 1/04

[52] U.S. Cl. ..... 75/585; 75/387; 75/375

[58] Field of Search ..... 75/585, 387, 375

[56] References Cited

U.S. PATENT DOCUMENTS

| | | | |
|---|---|---|---|
| Re. 29,584 | 3/1978 | Heise et al. | 75/557 |
| 3,754,895 | 8/1973 | Ramachandran et al. | 75/382 |
| 3,816,720 | 6/1974 | Bauer et al. | 75/382 |
| 4,564,390 | 1/1986 | Gupta et al. | 75/546 |
| 5,584,909 | 12/1996 | Kim | 75/387 |

*Primary Examiner*—Prince Willis
*Assistant Examiner*—Tima McGuthry-Banks
*Attorney, Agent, or Firm*—Cohen, Pontani, Lieberman & Pavane

[57] ABSTRACT

A process for decarburizing a steel melt for the production of high-chromium steels by blowing in oxygen in which the decarburization rate is continuously measured and the amount of oxygen to be injected is adjusted depending on the measured values. The following controlled quantities are calculated:

a) the duration of the Al—Si oxidation phase at the start of the decarburization process, b) the duration of a principle decarburization phase immediately following the Al—Si oxidation phase until the transition point from the decarburization reaction to the metal oxidation is reached, and c) the decarburization rate in the principal decarburization phase. The injected oxygen quantity is increased at an accelerated rate immediately following the Al—Si oxidation phase to the oxygen quantity of the principal decarburization phase until the decarburization rate calculated in c) is reached. The decarburization rate is maintained substantially constant for the duration of the principal decarburization phase by the injected quantity of oxygen. The injected oxygen quantity is continuously reduced immediately following the principal decarburization phase so that the decarburization rate decreases continuously in time at a predetermined time constant.

3 Claims, 2 Drawing Sheets

PROCESS FOR DECARBONISING A HIGH-CHROMIUM STEEL MELT

BACKGROUND OF THE INVENTION

1. Field of the Invention

The invention is directed to a process for decarburizing a steel melt for the production of high-chromium steels by blowing in oxygen in which the decarburization rate is continuously measured and the amount of oxygen to be blown in is adjusted depending on the measured values. The decarburization rate is determined from the CO content and CO2 content in the exhaust gas and from the flow of exhaust gas.

2. Discussion of the Prior Art

DE 33 11 232 C2 discloses a process for decarburizing steel melts in which the process quantities by which the decarburization process is to be controlled are calculated on the basis of a theoretical model describing the course of decarburization in the steel melt. For this purpose, oxygen and a diluting gas are blown into the melt and the injected quantities are controlled corresponding to the course of decarburization by adjustable gas flow control means. The controlling of the injected quantities is carried out so that the extent of decarburization and the carbon content of the melt during the melting process is calculated with reference to the model and is compared with predetermined values. When the calculated value agrees with the predetermined value, the proportion of dilution gas and the gas quantity injected into the melt are changed in a predetermined manner. Accordingly, in this process, the characteristic quantities in the model, i.e., those inputted in the computing program, are compared with actual measured quantities and, by comparing the predetermined reference values and the calculated actual values, the control of the decarburization process is carried out so that the actual course of the process corresponds as far as possible to the course of the process simulated in the computer. The decarburization process can be controlled exactly by this computer-controlled decarburization process.

While this process is suitable for the decarburization of steel melts, this process based on the employed model is not suitable to determine exactly the time at which the point of transition from the decarburizing reaction to the metal oxidation is reached.

This results in increased chromium loss and accordingly additionally required quantities of reducing materials, for example, ferrosilicon and lime, as basic neutralization of the silicon content in the slag, and finally in a reduced life of the ladle or converter.

SUMMARY OF THE INVENTION

It is the object of the present invention to control, in an exact manner, the decarburization of a steel melt for the production of high-chromium steels by blowing oxygen into the melt such that, in particular, unwanted chromium oxidation is avoided and a strong decarburization of the melt and a minimum metal slagging are still achieved.

Pursuant to this object, and others which will become apparent hereafter, one aspect of the present invention resides in a process for decarburizing a steel melt for producing high-chromium steel. The process includes the steps of injecting oxygen into the melt, continuously measuring a rate of decarburization and continuously adjusting the amount of oxygen injected depending upon the measured values.

According to the invention, the following controlled variables are calculated by means of a computer on the basis of measured or predetermined values: the duration of the Al—Si oxidation phase at the start of the decarburization process, the duration of a principle decarburization phase immediately following the Al—Si oxidation phase until the transition point from the decarburization reaction to the metal oxidation is reached, and the decarburization rate in the principal decarburization phase, wherein the decarburization rate is determined in turn from the CO and CO2 content in the exhaust gas and the exhaust gas flow.

The process is conducted so that the injected oxygen quantity is increased at an accelerated rate immediately following the Al—Si oxidation phase to the oxygen quantity of the principal decarburization phase until the calculated decarburization rate occurs. Subsequently, the decarburization rate is maintained substantially constant for the duration of the principal decarburization phase by changing the injected quantity of oxygen. In the post-critical phase immediately following the principal decarburization phase, the injected oxygen quantity is continuously reduced in such a way that the decarburization rate decreases continuously in time at a predetermined time constant.

In this way, a maximum decarburization and minimum metal slagging, especially a minimum unwanted chromium oxidation, under the given conditions is achieved. The process according to the invention for the production of high-chromium steels makes use of the insight that there is a critical decarburization state in the course of the process, that is, a transition point from the decarburization reaction to the metal oxidation, which can be calculated with sufficient precision using a special model, and that conducting the process in an optimum manner is dependent on the timely detection of this state which, when exceeded, promotes metal oxidation, especially chromium oxidation, in the melt at the detriment of the decarburization reaction.

Only by determining the critical decarburization state is it possible to predict the process sequence over time as it relates to managing the process. When the input data of the preliminary metal are known, especially the chemical composition, the temperature the and weight, and the presetting of desired end data in the same form as the input data of the melt, the important variables for conducting the process with respect to regulation technique can be calculated beforehand with reference to the model.

A specific arrangement of the model for determining the critical decarburization state which makes it possible to determine the duration of the Al—Si oxidation phase $\Delta t_{Al-Si}$, the duration of the principal decarburization phase $\Delta t_{kr}$, and the decarburization rate in the principal decarburization phase is described by equations (1) to (5). This model assumes that during the principal decarburization phase, a virtually constant decarburization rate exists which, after the transition point from the decarburization reaction to metal oxidation is reached, passes into the immediately following post-critical phase. In this connection, the oxygen supply multiplied by the efficiency of the oxygen lance in the principal decarburization phase is constant.

A very small Cr loss is achieved in that the oxygen supply is reduced continuously over time as the decarburization rate decreases at the time constant $\tau_{kr}$ calculated by means of equations (1) to (5).

The control can be realized in a very simple manner by blowing in oxygen with adjustable gas flow control means.

In conducting the decarburization process, it is proposed that the quantity of the injected oxygen be adjusted to a predetermined flow quantity for the duration of the Al—Si oxidation phase, so that the foaming of the slag does not exceed a determined intensity.

BRIEF DESCRIPTION OF THE DRAWINGS

An example of the invention is explained more fully with reference to the accompanying drawing.

DETAILED DESCRIPTION OF THE PREFERRED EMBODIMENTS

Figure 1:
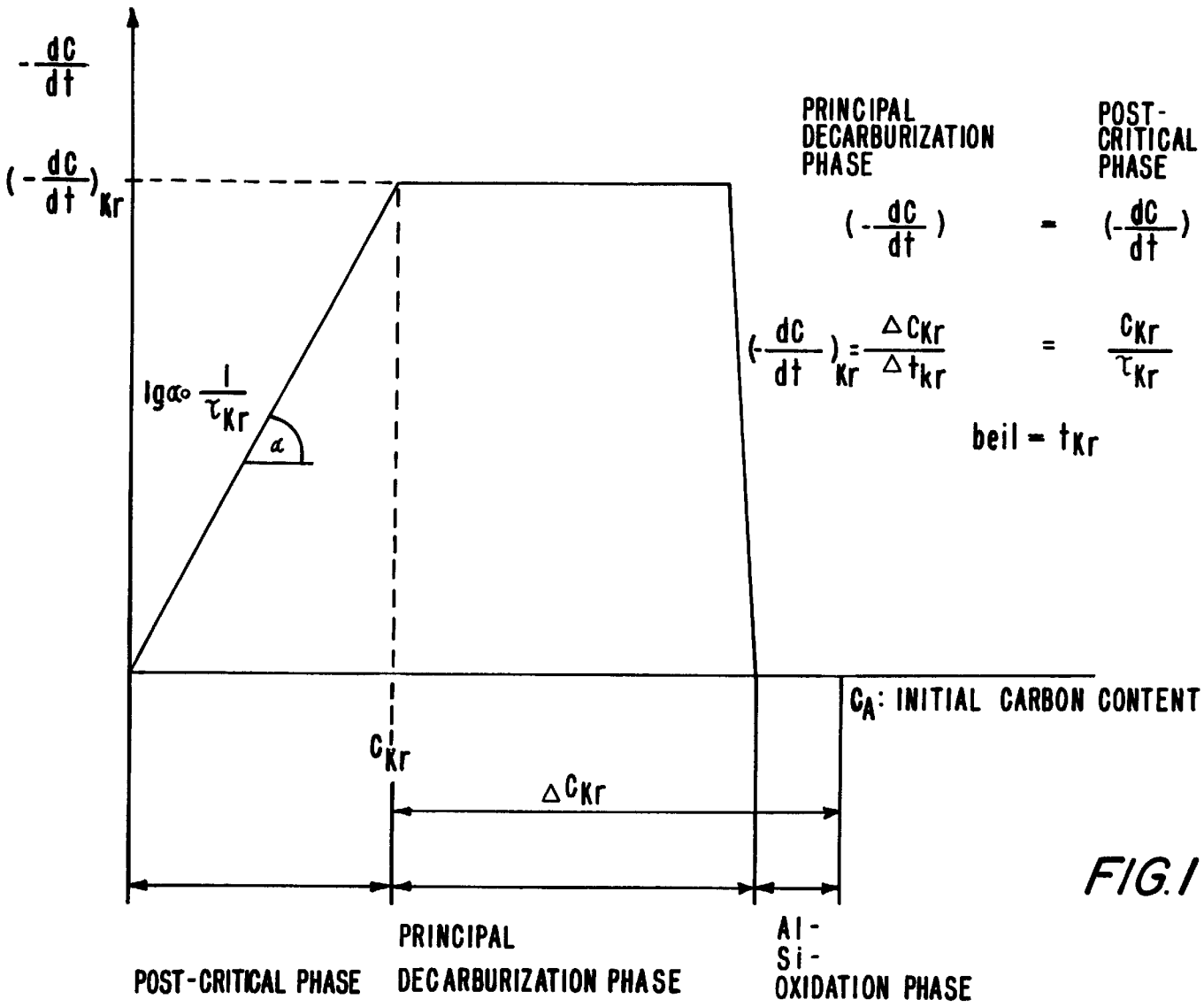
FIG. 1 shows the decarburization kinetics of the model serving as basis.

FIG. 1 shows schematically the decarburization kinetics of the base model. The decarburization rate is plotted on the y axis and the carbon content of the melt is plotted on the x axis. As is shown by FIG. 1, the principal decarburization phase is characterized by a constant decarburization rate which passes continuously into the post-critical phase after the critical transition point from the decarburization reaction to metal oxidation is reached. From this view point, the critical transition point is associated both with the principal decarburization phase and with the post-critical phase. Accordingly, the different kinetics of the decarburization reaction applicable to both phases are identical, i.e.:

$$\Delta Ckr/\Delta tkr = Ckr/\tau kr \quad (1),$$

where

ΔCkr is the carbon loss until the critical point in %,

Δtkr is the duration of the principal decarburization phase,

Ckr is the critical carbon content in %,

τkr is the operation reaction time constant in minutes.

The actual decarburization takes place during the principal decarburization phase, i.e., after the Al—Si loss until reaching the critical transition point. As is well known, metal oxidation, principally oxidation of chromium, manganese, and iron, takes place parallel to the carbon oxidation. This results in the following equation for the oxygen balance:

$$\Delta O2,C + \Delta O2,Me = \eta HQO2,H\ \Delta tkr \quad (2),$$

where

ΔO2,C is the oxygen requirement for carbon loss until the critical point in Nm3/min, ΔO2,Me is the oxygen requirement during metal loss until the critical point in Nm3/min, ηH is the efficiency of the oxygen lance in the principal decarburization phase, QO2,H is the quantity of the injected oxygen in the principal decarburization phase in Nm3/min The appearance of the energy balance of the melt is such that the instantaneous energy content of the melt is composed of the initial energy content of the pre-metal and of the stored energy which is equal to the difference between the energy supply and the energy loss. Further, it is assumed that the reference temperature of the melt reached first at the critical point only increases slightly during further processing in the post-critical phase. The proposed process control in which only a slight chromium slagging occurs during the post-critical phase is based on the above assumption. The release of energy during the carbon and chromium loss is compensated for the most part by the occurring energy loss. The energy balance is accordingly as follows:

$$\begin{aligned} CTP\,(GA/1000)\Delta Tsoll = {} & CTP\,(GA/1000)const1\,\Delta Si/0.1 + \\ & CTP\,(GA/1000)const2\,\Delta Al/0.1 + \\ & CTP\,(GA/1000)(const3 + \\ & \lambda const4)\Delta Ckr/0.1 + \\ & CTP\,(GA/1000)const5\,\Delta Ckr/0.1 + \\ & CTP\,(GA/1000)const6\,\Delta Fekr/0.1 + \\ & CTP\,(GA/1000)const7\,\Delta Mnkr/0.1 + - \\ & (CGP/1000)(const8\ GA\ \Delta Ckr/100 + \\ & Q\mathrm{Ar,\ Al\text{-}Si}\,\Delta t\mathrm{Al\text{-}Si} + \\ & Q\mathrm{Ar,\ H}\,\Delta tkr)(T0 + Tsoll/2) - \\ & CTP\,\Delta TW\,\Delta QW\,(\Delta t\mathrm{Al\text{-}Si} + \Delta tkr) - \\ & CSP\,(\Delta t\mathrm{Al\text{-}Si} + \Delta tkr)/60 - \\ & \sum (Gi/1000)\ \mathrm{Ci}, \end{aligned} \quad (3)$$

where

GA is the weight of the melt in kg

ΔSi is the Si loss, where const1=25 to 40 K/0.1% Si loss

ΔAl is the Al loss, where const2=25 to 45 K/0.1% Al loss

ΔCkr is the C loss, where const3=5 to 20 K/0.1% C loss and A is the proportion (const4=20 to 40) of the CO subsequent combustion ΔCrkr is the Cr loss, where const5=5 to 20 K/0.1% Cr loss ΔFekr is the Fe loss, where const6=1 to 10 K/0.1% Fe loss ΔMnkr is the Mn loss, where const7=5 to 20 K/0.1% Mn loss CTP is the specific heat capacity of the melt in KWh/K/t λ is the proportion of CO subsequent combustion in the vessel CGP is the specific heat capacity of the waste gas in KWh/Nm3/K QAr,Al—Si, QAr,H is the Ar inert gas flow in the Al—Si and principal decarburization phase in Nm3/min CWP is the specific heat capacity of the cooling water in KWh/l/K ΔTw is the temperature difference between inlet and outlet in K QW is the mean cooling water flow in l/min CSP is the radiation output of the wall in KW Gi is the feed "i" in kg Ci is the enthalpy of the alloy "i" in KWh/t T0 is the temperature of the premetal in ° C.

The right-hand side of the energy balance equation (3) has several terms provided with a positive mathematical sign which account for the thermal energy released through the metal loss (metal oxidation). The intensity of the metal loss is characterized, for the individual metals, by the constants const. 1 to const. 7. This relates to typical parameters for the melting furnace and the melt. The terms of equation (3) with a negative sign comprise the energy loss through the off-gas discharge, through the water cooling, through the heat radiation and the energy requirement for melting in the alloys and slags.

The relationship between the temperatures relevant for the process follows from equation (4):

$$Tsoll = Tskr - T0 \quad (4),$$

where

TSkr is the reference temperature of the melt at the critical point in ° C, and

ΔTsoll is the reference temperature increase in the melt at the critical point in ° C.

T0 is the temperature of the melt at the start of the treatment in ° C.

The essential quantity given by the solution to the equation system (1), (2) and (3) is the critical carbon loss ΔCkr. With this quantity, the critical carbon content ΔCkr which is the carbon content at the transition point of the melt according to FIG. 1 is given by the following equation:

$$Ckr=CA-\Delta Ckr \quad (6),$$

wherein CA is the initial carbon content of the melt.

The decarburization rate can be calculated by taking into account the following equation according to FIG. 1:

$$(-dC/dt)=\Delta Ckr/\Delta tkr=Ckr/\tau kr \quad (5).$$

In addition to the critical carbon content Ckr, the solution to the equation system (1)–(4) gives the process times tkr and tAl—Si which are very important with respect to regulation technique. The fourth unknown determined by the equation system is the quantity (T0+ΔTsoll/2). Using this value in equation (4) gives Tskr—the reference temperature of the melt at the critical point.

The model for determining the critical decarburization state is clearly described by equations (1) to (5) and makes it possible to determine the control quantities relevant for the decarburization process: the duration of the Al—Si oxidation phase ΔtAl—Si, the duration of the principal decarburization phase Δtkr, and the decarburization rate in the principal decarburization phase.

Figure 2:
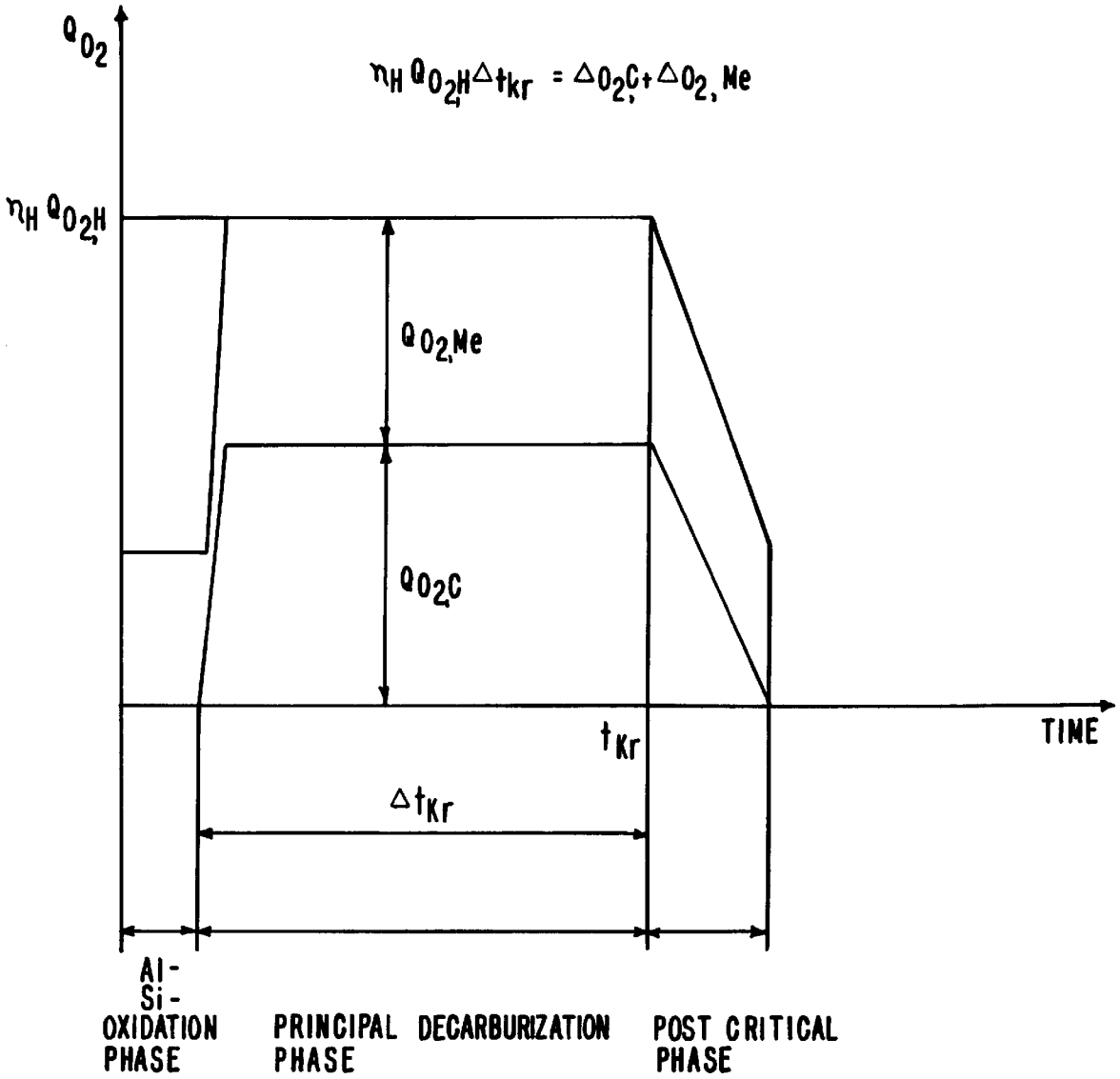
FIG. 2 shows the oxygen balance of the decarburization kinetics according to FIG. 1.

The decarburization process is carried out in such a way that the relevant control variables are calculated at the start of decarburization by means of equations (1) to (5). The further process sequence is shown schematically in FIG. 2. In the Al—Si oxidation phase, a predetermined oxygen flow and a predetermined inert gas flow (for example, argon) are adjusted and conducted through the melt. The predetermined values are in a range in which the foaming of the metal slag does not exceed the permissable values. Immediately following the Al—Si oxidation phase, the inert gas supply is turned off and the supplied oxygen quantity is increased at an accelerated rate until the decarburization rate which is calculated for the principal decarburization phase and which is determined from the CO and CO2 content in the exhaust gas and from the exhaust gas flow occurs. This decarburization rate is maintained substantially constant through the regulation of the oxygen supply during the principal decarburization phase. When the critical transition point tkr is reached, the supplied oxygen amount is reduced in proportion with respect to time at time constant tkr.

The special nature of the invention consists in that the metal bath concentrations of the chemical elements, the metal bath temperature at the critical point and the time of its occurrence are determined. Further, the chemical-thermodynamic ratios of the chemical reactions taking place in the metal bath at the critical transition point are calculated. With respect to the maximum instantaneous decarburization and the minimum metal slagging, these reaction courses are optimum. The optimum reaction course is contained in the post-critical decarburization phase in that the process quantities calculated for the critical transition point on the basis of the model are utilized for controlling the post-critical phase, so that the unwanted chromium oxidation, oxygen consumption and consumption of reducing materials, especially silicon, can be substantially minimized. The oxygen flow quantity is controlled via the decarburization rate as in the principal decarburization phase.

Moreover, the determination of the critical state with reference to the model makes it possible to define the optimum input data of the melt. The possibilities for applying the process extend in principle to all processes which take place accompanied by reduced effect of carbon relative to chromium oxidation. Such processes include the vacuum oxidizing process (VOD) and the AOD (Argon Oxygen Decarburization) converter process with all technical modifications.

What is claimed is:

1. A process for decarburizing a steel melt containing Mn, Al and Si for producing high-chromium steels, comprising the steps of:

injecting oxygen into the melt;

continuously measuring a rate of decarburization, including calculating as control quantities:

a) a duration of an Al—Si oxidation phase at a start of decarburization, b) a duration of a principal decarburization phase immediately following the Al—Si oxidation phase until a transition point from a decarburization reaction to metal oxidation reached, the Al—Si phase and the principal decarburization phase both having a flow of Ar inert gas, and c) a decarburization rate in the principal decarburization phase; and adjusting an amount of oxygen injected depending on quantities measured and calculated during the measuring step, including increasing a quantity of injected oxygen at an accelerated rate immediately following the Al—Si oxidation phase to an oxygen quantity of the principal decarburization phase until the decarburization rate calculated in c) is reached, maintaining the decarburization rate substantially constant for the duration of the principal decarburization phase by way of the injected quantity of oxygen, and continuously reducing the injected oxygen quantity immediately following the principal decarburization phase so that the decarburization rate decreases continuously in time at a time constant.

2. A process according to claim 1, wherein the calculating step includes calculating the duration of the Al—Si oxidation phase ΔtAl—Si, the duration of the principal decarburization phase Δtkr, and the decarburization rate in the principal decarburization phase based on a model described by the following equations (1) to (5):

$$\Delta Ckr/\Delta tkr=Ckr/\tau kr \quad (1),$$

where

ΔCkr is carbon loss until the critical point in %,

Δtkr is the duration of the principal decarburization phase,

Ckr is critical carbon content in %,

τkr is the operation reaction time constant in minutes, $$\Delta O2,C+\Delta O2,Me=\eta HQO2,H\ \Delta tkr \quad (2),$$

where

ΔO2,C is oxygen requirement for carbon loss until the critical point in Nm3/min, ΔO2,Me is the oxygen requirement during metal loss until the critical point in Nm3/min, ηH is efficiency of an oxygen lance for injecting the oxygen in the principal decarburization phase, QO2,H is the quantity of the injected oxygen in the principal decarburization phase in Nm3/min, $$CTP\,(GA/1000)\Delta Tsoll = CTP\,(GA/1000)const1\Delta\mathrm{Si}/0.1 + CTP\,(GA/1000)const2\Delta Al/0.1 + CTP\,(GA/1000)(const3 + +\lambda const4)\Delta Ckr/0.1 + CTP\,(GA/1000)const5\Delta Ckr/0.1 + CTP\,(GA/1000)const6\Delta Fekr/0.1 + CTP\,(GA/1000)const7\Delta Mnkr/0.1 + - (CGP/1000)(const8\ GA\ \Delta Ckr/100 + Q\mathrm{Ar,\ Al\text{-}Si}\Delta t\mathrm{Al\text{-}Si} + Q\mathrm{Ar,\ H}\Delta tkr)(T0 + Tsoll/2) - CTP\Delta TW\Delta QW\left(\Delta t\mathrm{Al\text{-}Si} + \Delta tkr\right) - CSP\left(\Delta t\mathrm{Al\text{-}Si} + \Delta tkr\right)/60 - \sum(Gi/1000)\,\mathrm{Ci}, \quad (3)$$

wherein

GA is weight of the melt in kg

ΔSi is Si loss, where const1=25 to 40 K/0.1% Si loss

ΔAl is Al loss, where const2=25 to 45 K/0.1% Al loss

ΔCkr is C loss, where const3=5 to 20 K/0.1% C loss and λ is a proportion (const4=20 to 40) of CO subsequent combustion ΔCrkr is Cr loss, where const5=5 to 20 K/0.1% Cr loss ΔFekr is Fe loss, where const6=1 to 10 K/0.1% Fe loss ΔMnkr is Mn loss, where const7=5 to 20 K/0.1% Mn loss CTP is specific heat capacity of the melt in KWh/K/t λ is a proportion of CO subsequent combustion in a melt vessel CGP is specific heat capacity of exhaust-gas in KWh/Nm3/K QAr,Al—Si, QAr,H is Ar inert gas flow in the Al—Si phase and principal decarburization phase in Nm3/min CWP is specific heat capacity of the cooling water in KWh/l/K ΔTw is a temperature difference between inlet and outlet in K QW is a mean cooling water flow in l/min CSP is radiation output of a vessel wall in KW Gi is feed "i" in kg Ci is enthalpy of the melt "i" in KWh/t T0 is temperature of the melt at a start of the treatment in ° C.

where $$Tsoll = Tskr - T0 \quad (4),$$

where

TSkr is a reference temperature of the melt at the critical point in ° C.

ΔTsoll is the reference temperature increase in the melt at the critical point in ° C., where $$(-dC/dt) = \Delta Ckr/\Delta tkr = Ckr/\tau kr \quad (5).$$

3. A process according to claim 2, including continuously reducing the decarburization rate after reaching the critical point in time at time constant τkr.

* * * * *